United States Patent [19]

Zerfass et al.

[11] Patent Number: 4,987,027

[45] Date of Patent: Jan. 22, 1991

[54] SUPPORT WEB FOR ROOF FOUNDATION WEBS

[75] Inventors: Karl-Christian Zerfass; Franz Kaulich, both of Bobingen; Michael Schöps, Grossaitingen; Hans Wagner, Bobingen; Bertrand C. Weiter, Augsburg, all of Fed. Rep. of Germany

[73] Assignee: Hoechst Aktiengesellachaft, Frankfurt am Main, Fed. Rep. of Germany

[21] Appl. No.: 405,950

[22] Filed: Sep. 12, 1989

[30] Foreign Application Priority Data

Sep. 14, 1988 [DE] Fed. Rep. of Germany ..... 38312719

[51] Int. Cl.[5] ..... B32B 27/34

[52] U.S. Cl. ..... 428/287; 428/289; 428/291; 428/297; 428/303; 428/489

[58] Field of Search ..... 428/289, 297, 489, 287, 428/291

[56] References Cited

U.S. PATENT DOCUMENTS 4,714,651 12/1987 Hartmann et al. ..... 428/289

*Primary Examiner*—James J. Bell

[57] ABSTRACT

A support web is described for roof foundation webs which comprises a spunbonded web of polyester filaments. The spunbonded web has a basis weight of 50 to 100 g/m$^2$ and a filament denier of 1 to 8 dtex. It has been thermomechanically preconsolidated by means of a smooth calender and end-consolidated by means of a binder. This produces a high tear propagation resistance and nail removal resistance and good dimensional stability at high temperatures. The spunbonded web is therefore particularly suitable for use as a support web for bituminized roof foundation webs.

7 Claims, No Drawings

SUPPORT WEB FOR ROOF FOUNDATION WEBS

The invention relates to a support web for roof foundation webs and to a roof foundation web produced with said support web.

Roof foundation webs are as we know used underneath the tiles or slates of pitched roofs or the like as protection against drifting snow, dust, etc. Roof foundation webs should on the one hand be water-impermeable and on the other air- and vapor-permeable. They should also be very strong, in particular in terms of tear propagation resistance, in order for example to be able to support the weight of someone working on the roof who has slipped.

Roof foundation webs made of mesh-reinforced plastic sheeting are very common. It is true that this sheeting has a good breaking strength; but its tear propagation resistance and frequently the vapor permeability are unsatisfactory.

German Offenlegungsschrift DE-A-3,425,794 discloses a roof foundation web made of polyurethane sheeting overlaid with a layer of bonded fiber web made for example of polyester. The introductory part of this Offenlegungsschrift mentions a foundation web made of a high-strength polyester spunbonded web coated with a water-repellent and breathable special coating material in the form of a paste. However, this publication does not reveal anything about the structure of the bonded polyester webs used.

European Patent EP-B-0,027,750 describes a support web for a roof foundation web, which comprises a polypropylene, polyethylene, polyester or polyvinyl fiber web and has a basis weight between 85 and 200 g/m$^2$. To fabricate the roof foundation web, the fiber web is provided on one side with a layer of bitumen by coating the fiber web with hot bitumen and then cooling it in order to create microholes and microcracks. However, this publication does not reveal anything in respect of the structure of the fiber web, apart from the fiber material used and the basis weight.

It is an object of the invention to provide a support web for roof foundation webs which ensures a high strength, in particular a high tear propagation resistance, of the roof foundation web and which possesses good dimensional stability even at high processing temperatures.

Starting from a support web for roof foundation webs which comprises a spunbonded web made of polyester, in particular polyethylene terephthalate filaments, this object is achieved according to the invention when the spunbonded web has a basis weight of 50 to 100 g/m$^2$ and a filament denier of 1 to 8 dtex and is thermomechanically preconsolidated by calendering and end-consolidated by means of a binder. The calendering can be carried out with a smooth calender or an embossed calender, specifically an embossed calender bearing a shallow plain-weave pattern.

As has been found in trials, the support web has thanks to the structure of the spunbonded web according to the invention, good dimensional stability even at high processing temperatures. This is important for the fabrication of roof foundation webs where the support web is provided with bitumen. In particular in the course of the support web being impregnated with bitumen the temperatures are 60 to 180° C. As has been found, the support web formed according to the invention has good dimensional stability even at these high temperatures, which is very important for the processing of the support web. By contrast, support webs made of polypropylene, which has a softening point of about 156° C., are for example less suitable for bituminization.

As mentioned above, to fabricate a roof foundation web the support web is preferably used in conjunction with bitumen. It is in fact preferably soaked with bitumen, although it may also be coated with bitumen, in which case it is preferably coated on both sides.

The support web formed according to the invention has a tear propagation resistance of the order of 20 N to 80 N, a nail removal resistance of 50 N to 180 N and a perforation stability of 400 N to 1200 N. The relevant criteria for assessing these quantities are DIN 53356 in the case of the tear propagation resistance, the UEATC standard in the case of the nail removal resistance and DIN 54307 in the case of the perforation stability.

However, instead of bitumen it is also possible to use another material, for example polyethylene or polyvinyl chloride, together with the spunbonded web according to the invention.

The low basis weight of the spunbonded web is advantageous for the vapor permeability and weight efficiency. Preferably, the basis weight of the spunbonded web is 70 to 90 g/m$^2$.

The fine denier of the filaments which make up the spunbonded web ensures good adhesion of the material, in particular bitumen, bonded to the spunbonded web, owing to the high specific surface area of the spunbonded web. Preferably, the denier of the spunbonded web filaments is 2 to 5 dtex, in particular 4 dtex.

A suitable binder is in particular an acrylate binder. The binder content is preferably 5 to 25% by weight, advantageously 10 to 15% by weight. Which specific binder is chosen depends on the specific interests of the user. Hard binders permit high processing speeds for an impregnation, in particular a bituminization, while a soft binder produces particularly high tear propagation and nail removal resistances.

In what follows, two illustrative embodiments are exemplified.

EXAMPLE I

The support web used was a spunbonded web of 4-dtex polyethylene terephthalate filaments. The spunbonded web was thermomechanically preconsolidated by means of a smooth calender and end-consolidated by means of a soft acrylate bonder. The basis weight of the support web was 100 g/m$^2$.

The support web was then provided on both sides with a coating of oxidation bitumen having a basis weight of 380 g/m$^2$ in total and then sprinkled with talc.

The roof foundation web fabricated in this manner had the following properties:

| | |
|---|---|
| Basis weight | 480 g/m$^2$ |
| Thickness | 0.6 mm |
| Ultimate tensile strength | 290 and 280 N/g cm in the longitudinal and transverse directions respectively |
| Ultimate tensile strength elongation | 25 and 30% in the longitudinal and transverse directions respectively |
| Tear propagation resistance | 40 and 50 N in the longitudinal and transverse directions respectively |
| Nail removal resistance | 140 and 170 N in the longitudinal and transverse |

-continued

| | |
|---|---|
| | directions respectively |

EXAMPLE II

The support web used was again a spunbonded web of 4 dtex polyethylene terephthalate filaments. The spunbonded web was thermomechanically preconsolidated by a smooth calender and end-consolidated by means of a hard acrylate binder. The basis weight of the support web was 100 g/m$^2$.

The support web was then impregnated with oxidation bitumen having a basis weight of 330 g/m$^2$ and sprinkled with talc.

The resulting roof foundation web had the following properties:

| | |
|---|---|
| Basis weight | 430 g/m$^2$ |
| Thickness | 0.6 mm |
| Ultimate tensile strength: | 380 and 430 N/g cm in the longitudinal and transverse directions respectively |
| Ultimate tensile strength elongation | 30 and 40% in the longitudinal and transverse directions respectively |
| Tear propagation resistance | 60 and 30 N in the longitudinal and transverse directions respectively |
| Nail removal resistance | 100 and 100 N in the longitudinal and transverse directions respectively. |

We claim:

1. A support web for roof foundation webs which comprises a spunbonded web of polyester, in particular polyethylene terephthalate filaments, wherein the spunbonded web has a basis weight of 50 to 100 g/m$^2$ and a filament denier of 1 to 8 dtex and has been thermomechanically preconsolidated by means of a smooth calender and end-consolidated by means of a binder.

2. The support web as claimed in claim 1, wherein the basis weight of the spunbonded web is 70 to 90 g/m$^2$.

3. The support web as claimed in claim 1, wherein the denier of the spunbonded web filaments is 2 to 5 dtex.

4. The support web as claimed in claim 1, wherein the binder is an acrylate binder.

5. The support web as claimed in claim 1, wherein the binder content is 5 to 25% by weight.

6. The support web as claimed in claim 1, wherein the binder content is 10 to 15% by weight.

7. A roof foundation web based on a support web as claimed in claim 1, wherein the support web has been impregnated or coated with bitumen, in particular coated on both sides.

* * * * *